US008260159B2

(12) United States Patent
Hasegawa

(10) Patent No.: US 8,260,159 B2
(45) Date of Patent: Sep. 4, 2012

(54) IMAGE FORMING APPARATUS WITH REDUCED DETERIORATION OF IMAGE QUALITY

(75) Inventor: Satoshi Hasegawa, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 77 days.

(21) Appl. No.: 12/829,753

(22) Filed: Jul. 2, 2010

(65) Prior Publication Data

US 2011/0002701 A1 Jan. 6, 2011

(30) Foreign Application Priority Data

Jul. 6, 2009 (JP) ..... 2009-159770

(51) Int. Cl.
*G03G 15/00* (2006.01)
*G03G 15/08* (2006.01)

(52) U.S. Cl. ..... 399/27; 399/254; 399/258

(58) Field of Classification Search ..... 399/27, 399/53, 258, 254
See application file for complete search history.

(56) References Cited

U.S. PATENT DOCUMENTS 5,523,832 A 6/1996 Hamamichi et al.
7,603,065 B2 * 10/2009 Yamaguchi et al. ..... 399/258

FOREIGN PATENT DOCUMENTS

JP 05-333692 12/1993
JP 2003-215910 A 7/2003
JP 2008-287013 11/2008

OTHER PUBLICATIONS

Machine translation of JP 2008-287013 dated Dec. 12, 2011.*
Office Action (Notice of Grounds of Rejection) dated May 10, 2011, issued in the corresponding Japanese Patent Application No. 2009-159770, and an English Translation thereof.

* cited by examiner

*Primary Examiner* — Sophia S Chen
(74) *Attorney, Agent, or Firm* — Buchanan Ingersoll & Rooney PC

(57) ABSTRACT

In an image forming apparatus, it is determined whether a shortage amount of toner in a developing device is greater than a threshold value of 4 g or not, when the power is turned on to start operation. As a result, if the shortage amount of toner in the developing device is greater than 4 g, an agitating operation is executed to agitate toner in the developing device prior to a printing operation. If the shortage amount is smaller than 4 g, the agitating operation is not executed. Then, a printing command is received, and if the agitating operation is not performed, control of an operation of supplying toner is started with a delay of at least for the time required for the agitating operation, after the printing operation is started.

10 Claims, 13 Drawing Sheets

IMAGE FORMING APPARATUS WITH REDUCED DETERIORATION OF IMAGE QUALITY

This application is based on Japanese Patent Application No. 2009-159770 filed with the Japan Patent Office on Jul. 6, 2009, the entire content of which is hereby incorporated by reference.

BACKGROUND OF THE INVENTION

1. Field of the Invention

The present invention relates to an image forming apparatus, and more particularly to an image forming apparatus configured to supply toner from a toner bottle to a developing device.

2. Description of the Related Art

Some of image forming apparatuses including a developing device for developing toner to form an image, such as electrophotographic copiers and electrophotographic printers, are configured to have a toner bottle inside thereof to supply toner from the toner bottle to the developing device. The amount of toner in the developing device is monitored by a toner sensor, and at a certain level or lower, toner is automatically supplied from the toner bottle.

When such an image forming apparatus is not operated for a long time, toner in the developing device settles and the bulk density of toner changes. The waveform detected by the toner sensor changes with the changing bulk density of toner. As a result, the amount of toner in the developing device cannot be detected accurately by the toner sensor. If toner is supplied to the developing device based on such sensor output, an inappropriate amount of toner may be supplied. For example, because of the changing bulk density of toner, the amount detected by the toner sensor may be smaller than the actual amount of toner in the developing device. If toner is supplied to the developing device based on such sensor output, the toner in the developing device becomes too much, possibly causing an overflow.

In order to solve the aforementioned problem caused by the changing bulk density of toner, for example, Japanese Laid-Open Patent Publication No. 2003-215910 discloses a technique of agitating toner in a buffer at "a prescribed timing" (developing agitation). This technique aims to prevent a change of bulk density by agitating toner in the developing device at a prescribed timing and thereby to prevent increase of loads on the developing sleeve or the agitating screw.

According to the technique disclosed in the document above, whether developing agitation before use is required or not this time is determined by comparing the toner sensor value during the last use with the toner sensor value during the current use. This technique, however, requires developing agitation for measurement in order to obtain the more accurate toner sensor value during the last use. Accordingly, unnecessary developing agitation is performed. Furthermore, in this technique, if it is determined that developing agitation is necessary as a result of the comparison of toner sensor values, developing agitation is performed without consideration of other circumstances, and therefore developing agitation that is not always necessary depending on other circumstances may be performed.

Toner is deteriorated with developing agitation. Therefore, the developing agitation performed as a result of the determination, as in the technique disclosed in the document above, may lead to deterioration of toner. To prevent deterioration of toner, it is effective to reduce the frequency of developing agitation. In other words, it is effective to properly set the above-noted "prescribed timing".

In order to reduce the frequency of developing agitation, for example, a technique may be added in which a notice is given to indicate the time during which the image forming apparatus is not operated. In this case, however, a clock function is necessary for counting the time during which the image forming apparatus is not operated. Thus, this technique cannot be applied to an image forming apparatus that does not have a clock function.

SUMMARY OF THE INVENTION

The present invention is made in view of the forgoing problems. An object of the present invention is to provide an image forming apparatus capable of preventing deterioration of image quality by reducing the frequency of agitating (developing agitating) toner in a developing device while effectively preventing a change of bulk density of toner in the developing device.

In order to achieve the object as described above, in accordance with an aspect of the present invention, an image forming apparatus includes: a toner container unit; an image forming unit including a developing device for forming a toner image on printing medium based on image data; a supply unit for supplying toner from the toner container unit to the developing device; an agitating unit for agitating the toner in the developing device; a memory for storing a shortage amount of toner in the developing device; and a controller for performing i) supply control for allowing the supply unit to execute a supply operation based on an amount of toner in the developing device to supply toner from the toner container unit to the developing device, ii) agitation control for allowing the agitating unit to execute an agitating operation to agitate toner in the developing device, and iii) image forming control for allowing the image forming unit to execute an image forming operation to form a toner image on the printing medium. The controller performs first control of allowing execution of the agitating operation before the start of the image forming operation and starting the supply control upon the start of the image forming operation, if the shortage amount of toner obtained from the memory at a time of power-on is greater than a first threshold value, and second control of starting the supply control after a time required for at least the agitating operation after the start of the image forming operation, without allowing execution of the agitating operation, if the shortage amount of toner obtained from the memory at a time of power-on is smaller than the first threshold value.

Preferably, the controller further performs third control of allowing execution of the agitating operation before the start of the image forming operation and allowing execution of the supply operation after the agitating operation and before the start of the image forming operation, if the shortage amount of toner obtained from the memory at a time of power-on is greater than a second threshold value greater than the first threshold value.

More preferably, the image forming apparatus further includes a sensor for detecting whether a prescribed amount of toner exists or not in the developing device. The shortage amount of toner is an amount that falls short of the prescribed amount of toner detected by the sensor. The controller performs the third control if it is detected by the sensor that the prescribed amount of toner does not exist in the developing device at a time of power-on and if the shortage amount of toner is greater than the second threshold value.

Preferably, the image forming apparatus further includes a sensor for detecting whether a prescribed amount of toner exists or not in the developing device. The shortage amount of toner is an amount that falls short of the prescribed amount of toner detected by the sensor. The controller performs the first control if it is detected by the sensor that the prescribed amount of toner does not exist in the developing device at a time of power-on and if the shortage amount of toner is greater than the first threshold value, and the second control if it is detected by the sensor that the prescribed amount of toner exists in the developing device at a time of power-on or if the shortage amount of toner is smaller than the first threshold value.

Preferably, the image forming apparatus further includes a calculation unit for calculating the shortage amount of toner in the developing device based on the image data.

In accordance with another aspect of the present invention, an image forming apparatus includes: a toner container unit; an image forming unit including a developing device for forming a toner image on printing medium based on image data; a supply unit for supplying toner from the toner container unit to the developing device; an agitating unit for agitating toner in the developing device; a memory for storing a shortage amount of toner in the developing device; and a controller for performing i) supply control for allowing the supply unit to execute a supply operation based on an amount of toner in the developing device to supply toner from the toner container unit to the developing device, ii) agitation control for allowing the agitating unit to execute an agitating operation to agitate toner in the developing device, and iii) image forming control for allowing the image forming unit to execute an image forming operation to form a toner image on the printing medium. The controller performs first control of allowing execution of the agitating operation before the start of the image forming operation and starting the supply control upon the start of the image forming operation, if the shortage amount of toner obtained from the memory is greater than a first threshold value at a time when image formation is requested, and second control of starting the supply control after a time required at least for the agitating operation after the start of the image forming operation, without allowing execution of the agitating operation, if the shortage amount of toner obtained from the memory is smaller than the first threshold value at a time when image formation is requested.

Preferably, the controller further performs third control of allowing execution of the agitating operation before the start of the image forming operation and allowing execution of the supply operation after the agitating operation and before the start of the image forming operation, if the shortage amount of toner obtained from the memory is greater than a second threshold value greater than the first threshold value at a time when image formation is requested.

More preferably, the image forming apparatus further includes a sensor for detecting whether a prescribed amount of toner exists or not in the developing device. The shortage amount of toner is an amount that falls short of the prescribed amount of toner detected by the sensor. The controller performs the third control if it is detected by the sensor that the prescribed amount of toner does not exist in the developing device at a time when image formation is requested and if the shortage amount of toner is greater than the second threshold value.

Preferably, the image forming apparatus further includes a sensor for detecting whether a prescribed amount of toner exists or not in the developing device. The shortage amount of toner is an amount that falls short of the prescribed amount of toner detected by the sensor. The controller performs the first control if it is detected by the sensor that the prescribed amount of toner does not exist in the developing device at a time when image formation is requested and if the shortage amount of toner is greater than the first threshold value, and the second control if it is detected by the sensor that the prescribed amount of toner exists in the developing device at a time when image formation is requested or if the shortage amount of toner is smaller than the first threshold value.

Preferably, the image forming apparatus further includes a calculation unit for calculating the shortage amount of toner in the developing device based on the image data.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
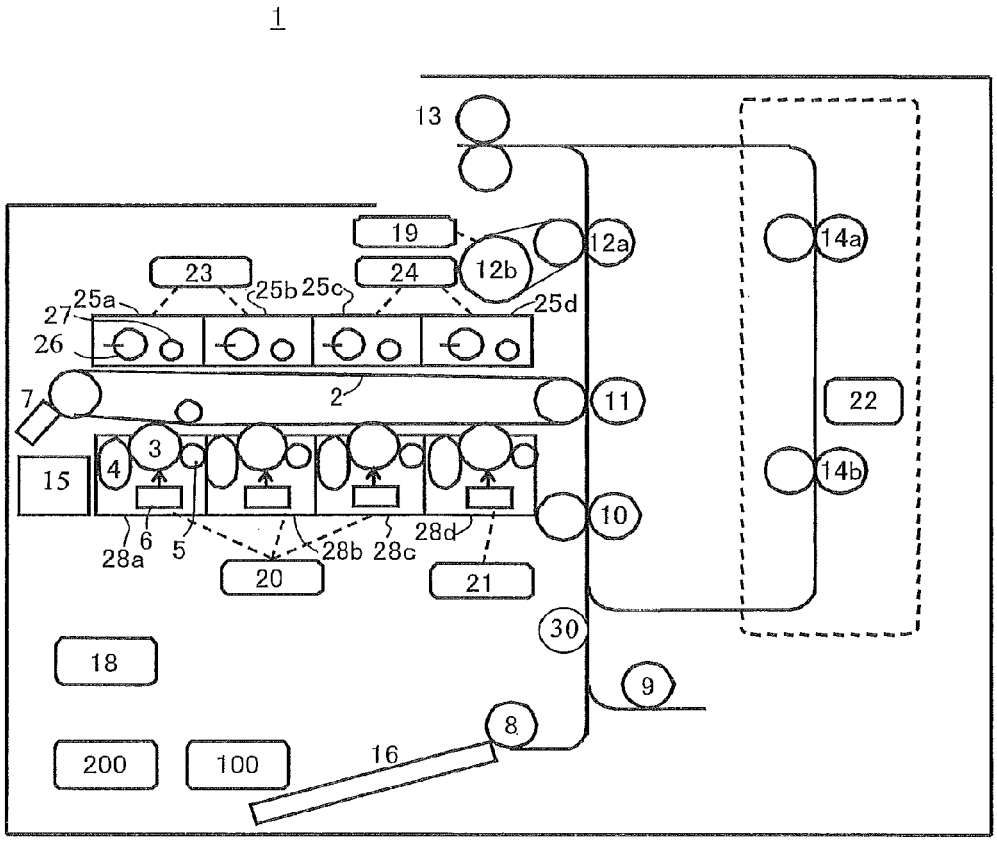
FIG. 1 is a schematic view showing an exemplary cross section of a central portion of a printer in accordance with an embodiment.

In the following, embodiments of the present invention will be described with reference to the figures. In the following description, the same parts and components are denoted with the same reference numerals. Their designations and functions are also the same.

In the following description, an image forming apparatus is a tandem color printer (abbreviated as printer hereinafter) by way of example. However, the image forming apparatus is not limited to a printer. The image forming apparatus performs an image forming process of developing toner, includes a toner bottle, and includes a mechanism for supplying toner from the toner bottle to a developing device. The image forming apparatus may be any other device having such a configuration, such as a copier, a facsimile, or an MFP (Multi Function Peripheral), which is a combination of those functions, or may be a monochrome printer.

Referring to FIG. 1, a printer 1 in accordance with an embodiment of the present invention includes an imaging unit and a transport unit for transporting paper as printing medium.

The imaging unit includes an annular intermediate transfer belt (hereinafter abbreviated as belt) 2 serving as an intermediate transfer unit, which is arranged approximately at a central portion inside printer 1 and suspended by a plurality of rollers from the inside. Cartridges 28*a*, 28*b*, 28*c* 28*d* are arranged along belt 2, corresponding to yellow (Y), magenta (M), cyan (C), and black (K). They are collectively referred to as cartridge 28. Each cartridge 28 includes, as a toner image forming mechanism for forming a toner image in an electrostatic recording method, a photoreceptor 3, a developing unit 4, a charging unit 5, and an exposure unit 6.

Photoreceptor 3 transfers a toner image onto belt 2. Charging unit 5 charges a surface of photoreceptor 3 uniformly. Exposure unit 6 exposes and successively forms an image pattern of each color onto photoreceptor 3. Developing unit 4 supplies toner to photoreceptor 3 to develop a toner image on photoreceptor 3.

Developing units 4 in color cartridges 28*a*, 28*b*, 28*c* are connected to a developing motor 20 to be driven by developing motor 20. Developing unit 4 in monochrome cartridge 28*d* is connected to a developing motor 21 to be driven by developing motor 21.

The imaging unit further includes a cleaner 7, a waste toner box 15, toner bottles 25*a*, 25*b*, 25*c*, 25*d*, and a secondary transfer roller 11. Toner bottles 25*a*, 25*b*, 25*c*, 25*d* are collectively referred to as toner bottle 25.

Cleaner 7 is disposed at a periphery of belt 2 to separate residual toner left on belt 2 from belt 2. Waste toner box 15 is used to store the separated residual toner.

Secondary transfer roller 11 pairs with the roller that suspends belt 2 from the inside, with belt 2 running between those rollers, and secondary transfer roller 11 transfers a toner image transferred on belt 2, onto the transported paper.

The transport unit includes a feed roller 8, a transport roller 30, a manual feed roller 9, a timing roller 10, the above-noted secondary transfer roller 11, a pair of fixing rollers 12*a*, 12*b* (they are collectively referred to as fixing rollers 12), a discharge roller 13, and duplex path transport rollers 14*a*, 14*b*.

Feed roller 8 feeds paper from a storage unit 16, which is a cassette for storing paper, arranged in a lower portion inside printer 1. Manual feed roller 9 feeds paper placed in a not-shown manual feed tray. Transport roller 30 transports paper supplied by feed roller 8 or manual feed roller 9. Timing roller 10 temporarily stops the paper transported by transport roller 30.

Fixing rollers 12 are connected to a fixing motor 19 to be rotatably driven by fixing motor 19. Fixing rollers 12 are arranged to sandwich the transported paper and are rotatably driven to heat and fix the toner image transferred on paper.

Discharge roller 13 discharges the paper after fixing or transports it to a duplex transport path 22. Duplex path transport rollers 14*a*, 14*b* transport the paper transported by discharge roller 13 after fixing, to timing roller 10 through duplex transport path 22.

Figure 2:
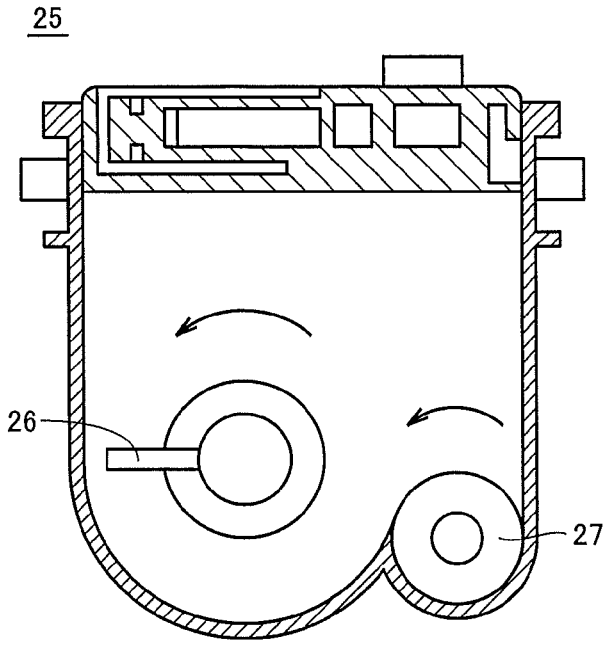
FIG. 2 is a schematic view showing an exemplary cross section of a toner bottle as viewed from the front side of the printer.

Referring to FIG. 1 and FIG. 2, each toner bottle 25 serving as a toner container unit includes an agitating roller 26 having a screw-like agitating blade and a supply roller 27. Agitating rollers 26 and supply rollers 27 in toner bottles 25*a*, 25*b* are connected to a toner supply motor 23, and forward/reverse rotation of toner supply motor 23 allows the respective agitating rollers 26 and supply rollers 27 of toner bottles 25*a*, 25*b* to rotate in the direction indicated by the arrows in FIG. 2. Agitating rollers 26 and supply rollers 27 in toner bottles 25*c*, 25*d* are connected to a toner supply motor 24, and forward/reverse rotation of toner supply motor 24 allows the respective agitating rollers 26 and supply rollers 27 of toner bottles 25*c*, 25*d* to rotate in the direction indicated by the arrows in FIG. 2.

Figure 3:
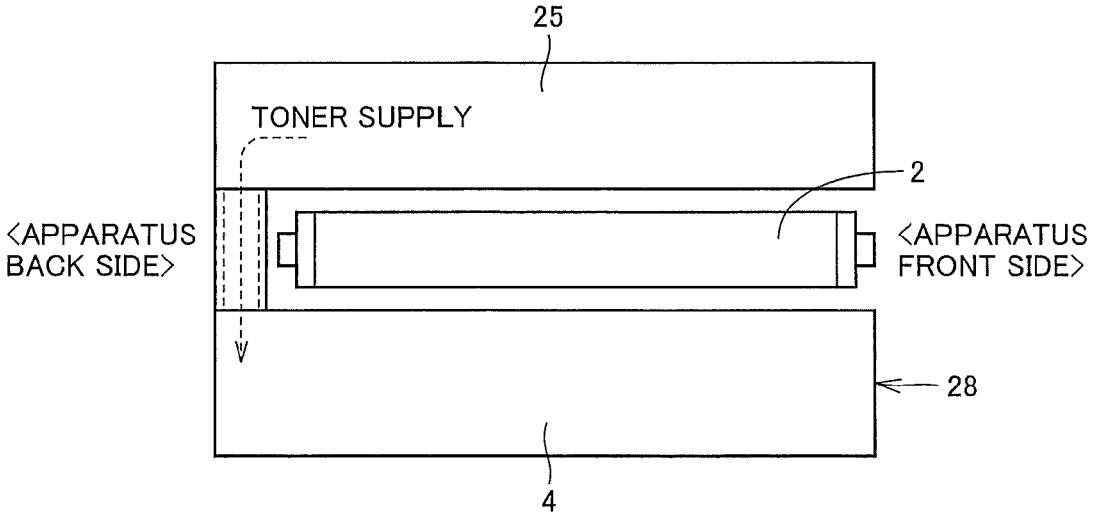
FIG. 3 is a schematic view as viewed from the side of the printer for illustrating joint between the toner bottle and a cartridge.

Referring to FIG. 3, toner bottle 25 located above belt 2 is joined with developing unit 4 in cartridge 28 located below belt 2, by a coupling member. The member for coupling toner bottle 25 with developing unit 4 has a hollow as illustrated in FIG. 3.

Toner supply motor 23 or toner supply motor 24 is activated to rotate agitating roller 26 and supply roller 27 connected thereto, whereby toner in toner bottle 25 passes through the hollow of the coupling member and then drops into developing unit 4. Therefore, these rollers can be said as a mechanism for supplying toner in toner bottle 25 to developing unit 4. The operation of activating toner supply motor 23 or toner supply motor 24 for a prescribed time to drop a prescribed amount of toner from toner bottle 25 into developing unit 4 is referred to as "toner supply operation." The operation modes of the toner supply operation include a normal mode and a forced mode. The toner supply operation in the normal mode is an operation for supplying toner by a predetermined prescribed amount in a normal printing operation and is executed at a timing depending on the amount of toner consumption during a printing operation or at a timing determined depending on the concentration or amount of toner in developing unit 4 during a printing operation. Furthermore, if the amount of toner in developing unit 4 is at a predetermined level or lower before the start of a printing operation, the toner supply operation in the normal mode is executed even before the start of a printing operation. The toner supply operation in the forced mode is an operation for supplying a greater amount of toner than the above-noted prescribed amount and is executed when toner is rapidly consumed during a printing operation or when the amount of toner in developing unit 4 runs short before a printing operation.

Figure 4:
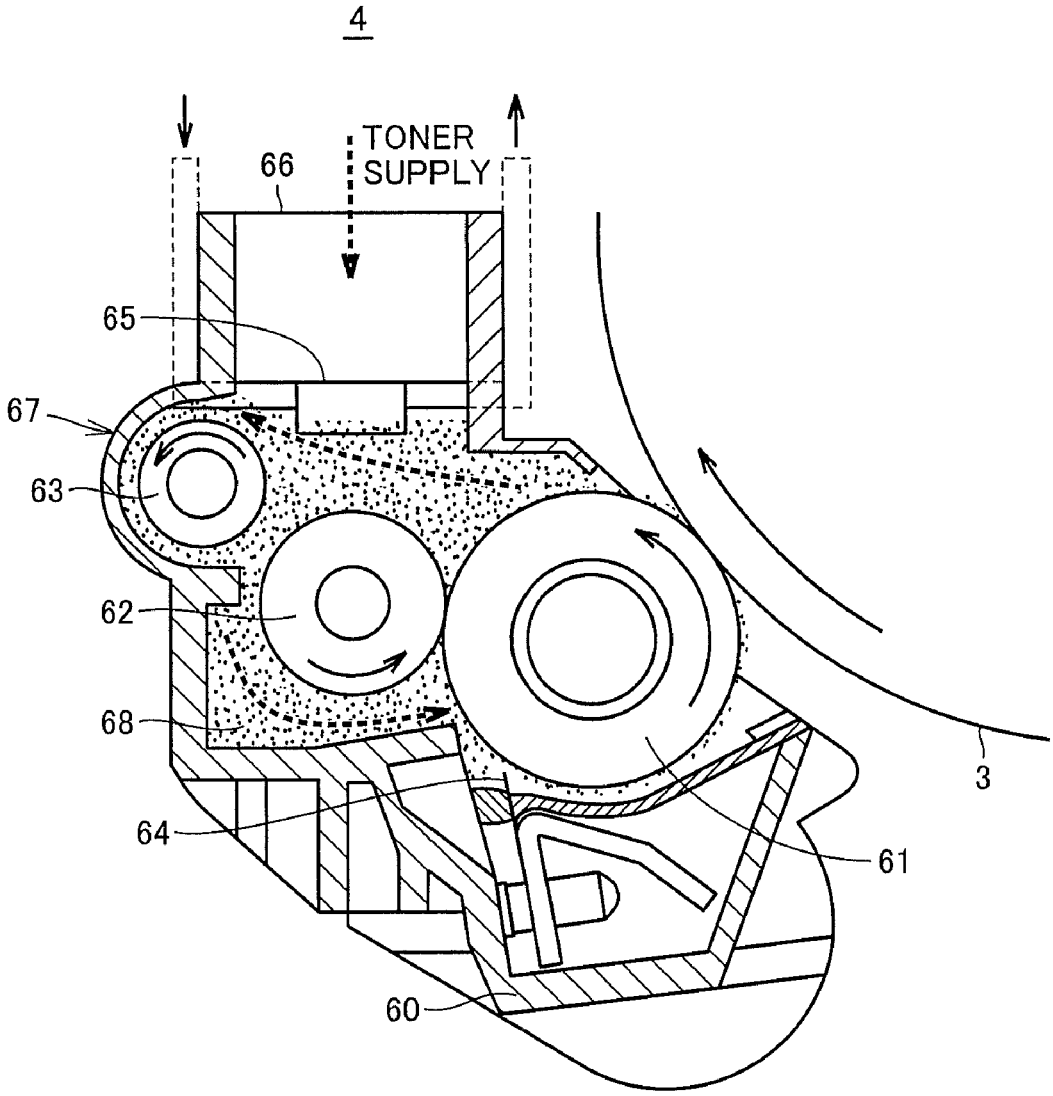
FIG. 4 is a schematic view showing an exemplary cross section of a developing unit in the cartridge.

Referring to FIG. 4, developing unit 4 includes a housing 60, a developing roller 61, a supply roller 62, an agitating roller 63, a blade 64, and a sensor 65. Developing roller 61, supply roller 62, and agitating roller 63 are rotatably held in housing 60. These rollers are connected to developing motor 20 or developing motor 21 to rotate in the direction indicated by the arrows in FIG. 4.

Housing 60 is filled with toner 68 as a developing material. Developing roller 61, supply roller 62, and agitating roller 63 are rotated by developing motor 20 or developing motor 21 in the direction indicated by the arrows in FIG. 4, so that toner 68 in housing 60 is circulated and agitated along the broken arrow in FIG. 4. Therefore, these rollers can be said as a mechanism for agitating toner in developing unit 4. The operation of activating developing motor 20 or developing motor 21 for a prescribed time to circulate toner 68 in housing 60 is referred to as "developing agitating operation," Developing roller 61, supply roller 62, and agitating roller 63 also rotate during a printing operation. Thus, toner in developing unit 4 circulates even in a printing operation.

Developing roller 61 is disposed at a location opposed to photoreceptor 3 to carry toner 68 in housing 60 and transport the toner to the location opposed to photoreceptor 3. At this location, toner 68 on developing roller 61 moves to the exposed portion of photoreceptor 3 to form a toner image. Supply roller 62 is disposed at a location in abutment with developing roller 61 to supply toner 68 in housing 60 to developing roller 61. Blade 64 has an end disposed to have a gap from the surface of developing roller 61 and restricts the amount of toner passing through the gap to form a uniform thin layer of toner 68 on developing roller 61. Agitating roller 63 agitates toner 68 in housing 60. On the top of housing 60, a supply port 66 is provided for receiving toner supplied from the corresponding toner bottle 25. A portion 67 of housing 60 that is outwardly curved along agitating roller 63 functions as a buffer for accumulating a certain amount of toner to be supplied to supply roller 62 in a region formed between portion 67 and agitating roller 63. The curved portion 67 is then referred to as buffer 67.

Sensor 65 is a transmission optical sensor including a light guide having a light-emitting element at one end and a light-receiving element at the other end. Sensor 65 is placed in the vicinity of buffer 67 in housing 60 to detect the amount of toner 68 in housing 60 in accordance with the quantity of transmitted light. Sensor signals from sensor 65 include a signal indicating that the quantity of transmitted light is smaller than a prescribed amount, that is, a signal indicating that housing 60 is filled with toner 68 up to the sensor 65 location, and a signal indicating that emission light passes through sensor 65, that is, a signal indicating that housing 60 is not filled with toner 68 up to the sensor 65 location. The state indicated by the former signal is referred to as "toner full state," and this signal is referred to as "toner full signal." The state indicated by the latter signal is referred to as "toner low state," and this signal is referred to as "toner low signal." It is noted that a sensing window of sensor 65 is cleaned using developing motors 20, 21 as a driving source in a reciprocating cleaning method.

In a toner supply operation, toner in developing unit 4 has to be circulated so that the supplied toner is evenly distributed in the interior. To that end, the toner supply operation is executed during operation of developing motor 20 or developing motor 21 and rotation of developing roller 61, supply roller 62, and agitating roller 63. Since these rollers are rotated during a printing operation, a developing agitating operation does not have to be performed for the toner supply operation in the normal mode which is performed during the printing process, aside from the printing operation.

The toner supply operation is performed depending on the amount of toner in developing unit 4. Control therefor is referred to as "toner supply control." The toner full state needs to be confirmed based on the sensor signal from sensor 65 in order to know the amount of toner in developing unit 4. When printer 1 is not operated for a long time and toner in developing unit 4 is not circulated, the bulk density of toner changes thereby decreasing the detection accuracy of sensor 65. The developing agitating operation is thus needed to correct the bulk density of toner, prior to the start of toner supply control.

Figure 5:
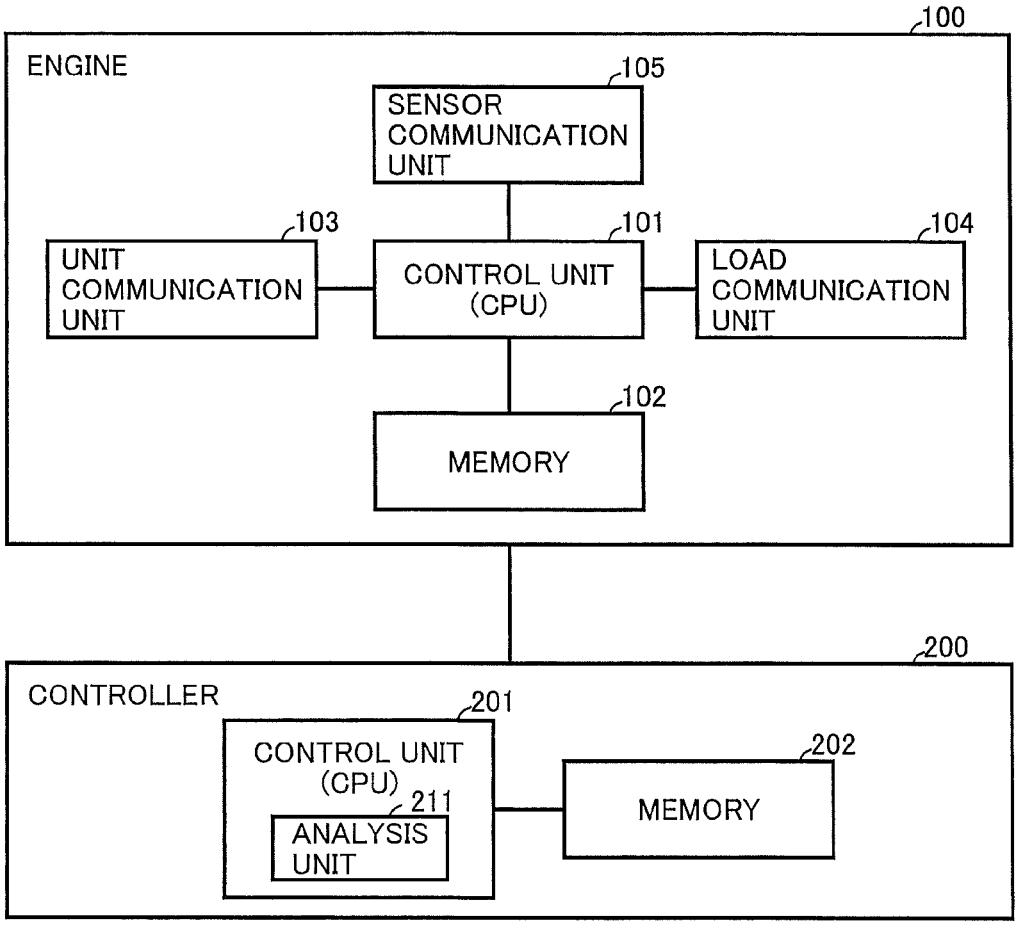
FIG. 5 is a diagram illustrating an engine and a controller of the printer.

Printer 1 further includes an engine 100 for controlling printer 1 as a whole, and a controller 200 for performing image processing in accordance with a control signal from engine 100. Referring to FIG. 5, engine 100 includes a control unit 101 including a CPU (Central Processing Unit), a non-volatile memory 102 attached to engine 100, a unit communication unit 103 for communicating with a non-volatile memory attached to cartridge 28 and the like, a load communication unit 104 for communicating with a variety of loads such as a main motor 18, and a sensor communication unit 105 for communicating with sensor 65. Controller 200 includes a control unit 201 including CPU, and a non-volatile memory 202 attached to controller 200.

Memories 102, 202 store respective programs executed in control units 101, 201. Control units 101, 201 control the entire printer 1 by reading necessary programs from memories 102, 202 and executing the programs by CPU.

Information of consumables and the like is stored in a not-shown memory attached to cartridge 28 or the like. Unit communication unit 103 reads the information of consumables in accordance with a control signal from control unit 101 and passes the same to control unit 101. Load communication unit 104 sends a control signal generated in control unit 101 to a load to be controlled.

Further referring to FIG. 5, control unit 201 of controller 200 includes an analysis unit 211. Analysis unit 211 is a function mainly formed in CPU by execution of the above-noted program by CPU of control unit 201 or may be realized by a hardware structure other than CPU.

Analysis unit 211 analyzes image data to be printed and specifies the number of dots that constitute the image. Preferably, analysis unit 211 specifies the number of dots for each toner color from image data to be printed. Controller 200 outputs the specified number of dots together with a printing instruction to engine 100.

Figure 6:
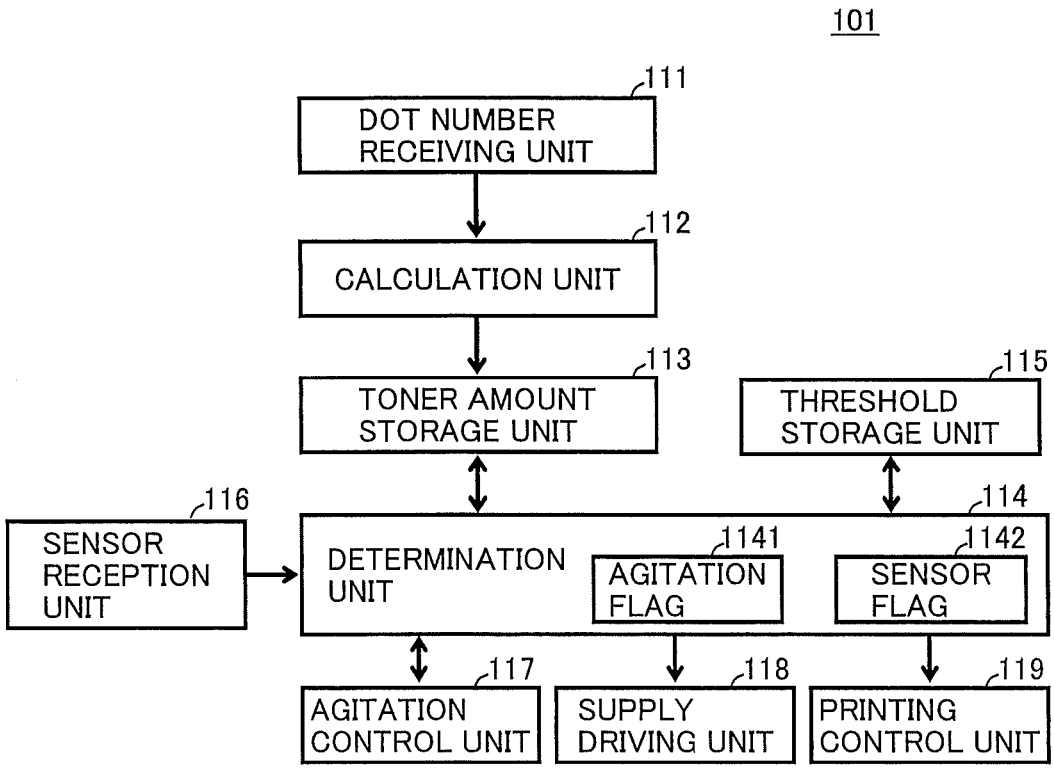
FIG. 6 is a block diagram showing an exemplary functional configuration of the engine.

Engine 100 determines the timings of executing the toner supply operation or the developing agitating operation and controls these operations to be executed at the determined timings. In order to perform such control, control unit 101 of engine 100 includes, as shown in FIG. 6, a dot number receiving unit 111 for receiving the number of dots from controller 200, a calculation unit 112, a toner amount storage unit 113, a determination unit 114, a threshold storage unit 115 for storing a threshold value for use in determination by determination unit 114, a sensor reception unit 116 for receiving a sensor signal from sensor 65, an agitation control unit 117 for executing the developing agitating operation, a supply driving unit 118 for executing the toner supply operation, and a printing control unit 119 for executing the printing operation. These are functions mainly formed in CPU by execution of the above-noted program by CPU of control unit 101. At least one of these functions may be realized by a hardware structure other than CPU.

Calculation unit 112 calculates the amount of toner required to print the specified image data, that is, the amount of toner consumed by printing, based on the number of dots received by dot number receiving unit 111. The calculated toner amounts are integrated in toner amount storage unit 113 from a point of time of the toner full state and are stored as the amount of toner consumption from the toner full state. In other words, the amount of toner (also referred to as "toner shortage amount") that falls short of the toner full state is stored in toner amount storage unit 113. Preferably, in a case where the number of dots for each toner color is output from controller 200, the toner shortage amount for each toner color is stored in toner amount storage unit 113. The toner full state or the toner low state is determined by determination unit 114 based on a sensor signal received by sensor reception unit 116.

A threshold value of the toner shortage amount that requires the developing agitating operation is stored in threshold value storage unit 115, as a threshold value for use in determination by determination unit 114. Stored as a first threshold value is a threshold value of the toner shortage amount for determining whether or not the amount of toner in developing unit 4 is such an amount that printing is possible but if a printing operation continues, the image quality may be reduced in the course of printing, that is, the image may be blurred. A specific value of the first threshold value may be 4 g, and in the following description, the first threshold value is assumed to be 4 g. If the current toner shortage amount is greater than 4 g, determination unit 114 determines that the image is not blurred immediately but, if the printing continues as it is, the image may be blurred in the course of printing. In this case, determination unit 114 performs toner supply control to allow supply driving unit 118 to execute the toner supply operation in the normal mode. This toner supply control is referred to as "normal-mode toner supply control."

Stored as a second threshold value is a threshold value of the toner shortage amount for determining whether or not the amount of toner in developing unit 4 is such an amount that the image quality cannot be ensured in the next printing operation, that is, the image may be blurred in the next printing. A specific value of the second threshold value may be 9 g, and in the following description, the second threshold value is assumed to be 9 g. If the current toner shortage amount is greater than 9 g, determination unit 114 determines that the image is immediately blurred in the next printing. In this case, determination unit 114 performs toner supply control to allow supply driving unit 118 to execute the toner supply operation in the forced mode. This toner supply control is referred to "forced-mode toner supply control."

Determination unit 114 compares the toner shortage amount stored in toner amount storage unit 113 with the threshold value stored in threshold storage unit 115 to determine whether the developing agitating operation is required or not and whether the toner supply operation is required or not. Based on this determination, determination unit 114 outputs a signal to agitation control unit 117 or supply driving unit 118 for requesting execution of the necessary operation. Preferably, determination unit 114 determines whether the developing agitating operation is required or not and whether the toner supply operation is required or not for each toner color, and then outputs a signal for requesting execution of the necessary operation. Alternatively, preferably, determination unit 114 determines whether the developing agitating operation is required or not and whether the toner supply operation is required or not for each toner color, and if it is determined that even one color requires the operation, determination unit 114 outputs a signal for requesting execution of the operation for all toner colors. Furthermore, determination unit 114 outputs a signal for requesting execution of a printing operation to printing control unit 119 in accordance with a printing instruction received by a not-shown reception unit from controller 200.

Agitation control unit 117 allows execution of the developing agitating operation in response to the request from determination unit 114. Preferably, agitation control unit 117 allows execution of the developing agitating operation for each toner color in response to the request from determination unit 114. Specifically, developing motor 20 and/or developing motor 21 is activated for a predetermined time. Accordingly, developing roller 61, supply roller 62, and agitating roller 63 in developing unit 4 are rotated to stir toner in developing unit 4.

Agitation control unit 117 outputs a signal to determination unit 114 to indicate that the agitating operation is executed, that is, developing motor 20 and/or developing motor 21 is activated for the above-noted predetermined time. Determination unit 114 includes an agitation flag 1141 and sets the flag when receiving the signal indicating execution of the developing agitating operation. Preferably, in the case where agitation control unit 117 allows execution of a developing agitating operation for each toner color, determination unit 114 includes agitation flag 1141 for each toner color and sets agitation flag 1141 for the toner color corresponding to developing unit 4 in which the developing agitating operation is executed by agitation control unit 117. Agitation flag 1141 is formed in a region of the non-volatile memory. Therefore, the information is held even during power-off, so that the toner shortage amount at the time of the previous power-off can be known as the toner shortage amount at the start of a printing operation by confirming the flag at the time of power-on.

Supply driving unit 118 allows execution of the toner supply operation in response to the request from determination unit 114. Preferably, supply driving unit 118 allows execution of the toner supply operation for each toner color, in response to the request from determination unit 114. Specifically, toner supply motor 23 and/or toner supply motor 24 is activated for a predetermined time. Accordingly, a prescribed amount of toner is supplied from toner bottle 25 to developing unit 4.

Supply driving unit 118 outputs a signal to determination unit 114 to indicate that the supply operation is executed, that is, toner supply motor 23 and/or toner supply motor 24 is activated for the above-noted predetermined time. Determination unit 114 receives the signal indicating execution of the supply operation and then resets toner amount storage unit 113, assuming that the toner full state is achieved. Preferably, in the case where supply driving unit 118 allows execution of the developing agitating operation for each toner color, determination unit 114 resets the toner shortage amount for the corresponding toner color, among the toner shortage amounts of the respective toner colors stored in toner amount storage unit 113. As a result, a toner shortage amount is newly stored in toner amount storage unit 113, starting from the toner full state. Here, determination unit 114 may reset toner amount storage unit 113 based on the toner full state determined from a sensor signal from sensor 65, in place of the above-noted signal from supply driving unit 118.

[First Embodiment]

Using FIG. 7, a first example of a flow of developing agitation control in accordance with a first embodiment will be described. The operation shown in FIG. 7 is an operation started by powering on printer 1 and is realized by control unit 101 of engine 100 reading the necessary program from memory 102 and executing the program in CPU for controlling the units shown in FIG. 5 and FIG. 6.

Figure 7:
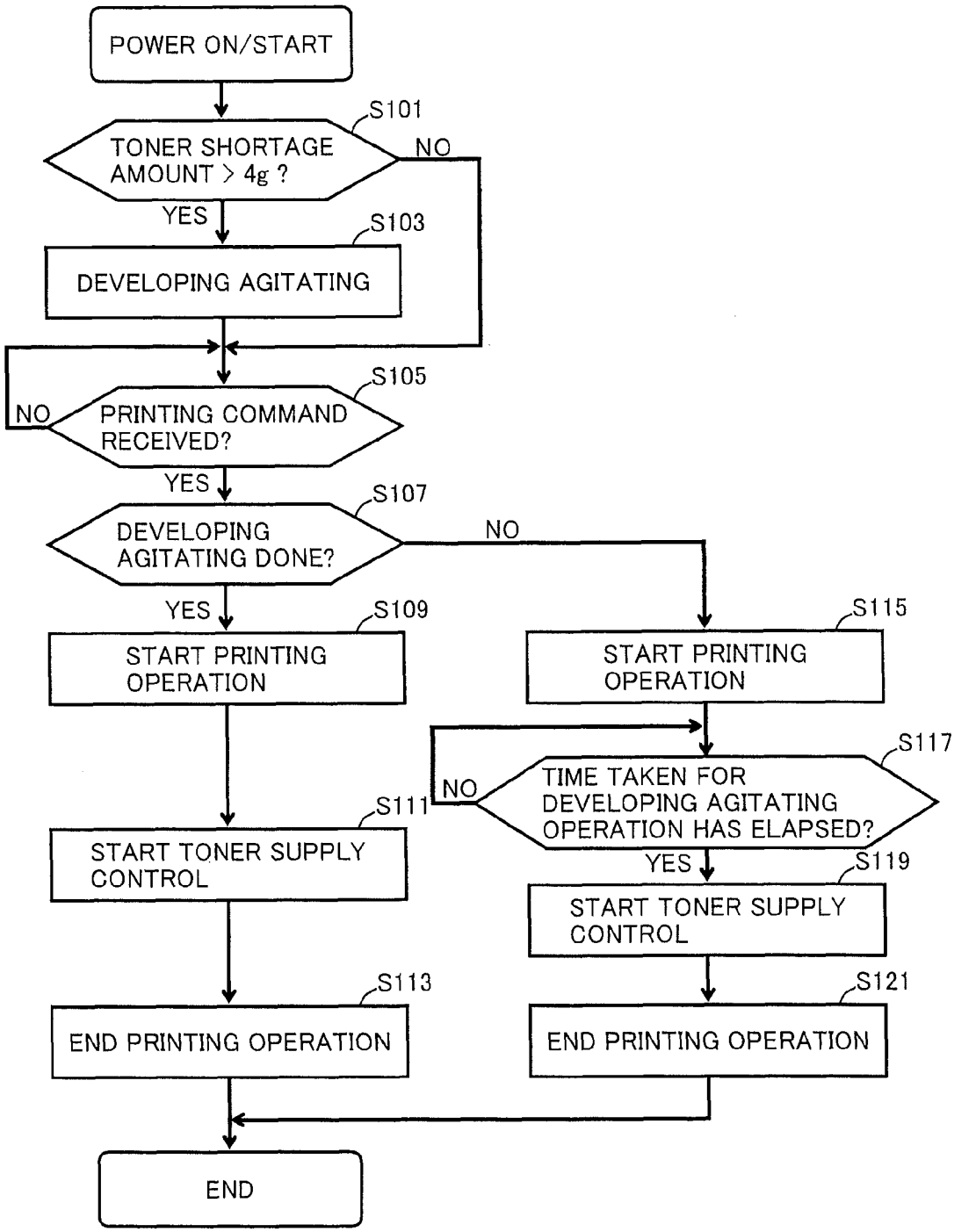
FIG. 7 is a flowchart showing a first example of a flow of developing agitation control in accordance with a first embodiment.

Referring to FIG. 7, when printer 1 is powered on and starts operating, determination unit 114 compares the toner storage amount stored in toner amount storage unit 113 with the first threshold value of 4 g stored in threshold storage unit 115. As a result, if it is determined that the toner shortage amount is greater than 4 g (YES in step S101), when a printing operation is thereafter started in response to a printing instruction, the image may be blurred in the printing operation. Therefore, control for the toner supply operation in the normal mode (normal-mode toner supply control) needs to be started immediately after the start of printing operation. Then, determination unit 114 determines that the developing agitating operation should be performed in order to correct the bulk density of toner in developing unit 4 in advance prior to the start of the normal-mode toner supply control. Upon such determination, determination unit 114 requests agitation control unit 117 to execute the developing agitating operation, in step S103. When this operation is done, determination unit 114 sets agitation flag 1141. If it is determined that the toner shortage amount is 4 g or less (NO in step S101), step S103 is skipped.

When a printing command is thereafter input from controller 200 (YES in step S105), determination unit 114 confirms whether the developing agitating operation is done in advance or not by confirming whether agitation flag 1141 is set or not. If it is determined that the developing agitating operation is done in advance in the above-noted step S103 (YES in step S107), in step S109, determination unit 114 determines to allow printing control unit 119 to start a printing operation in accordance with the aforementioned command and to start the toner supply control in the normal mode immediately after that. Upon such determination, in step S111, determination unit 114 determines whether the toner amount falls short or not, according to sensor 65, immediately after the start of the printing operation, and if it is short, determination unit 114 requests supply driving unit 118 to start the toner supply operation in the normal mode. Accordingly, the normal-mode toner supply control is started without the developing agitating operation being performed prior to the start of toner supply control after the start of the printing operation, and thereafter, the toner supply operation is performed in which toner is supplied at a timing depending on the amount of toner in developing unit 4. When the print job is ended, in step S113, determination unit 114 ends the printing operation. A series of operations is then ended.

If it is determined that the developing agitating operation is not done in the above-noted step S103 by confirming agitation flag 1141 (NO in step S107), toner exists in developing unit 4 in such an amount that printing is possible, at the start of the printing operation, and therefore there is no need for supplying toner immediately after the printing operation. In this case, in step S115, determination unit 114 allows printing control unit 119 to start the normal printing operation in accordance with the aforementioned command. Then, upon the start of the printing operation, determination unit 114 determines that the normal-mode toner supply control should be started at the timing later than the printing operation start by the time taken for the developing agitating operation. Upon such determination, determination unit 114 detects a lapse of the time taken for the developing agitating operation in step S103 from the start of the printing operation in step S115 (YES in step S117) and then starts the normal-mode toner supply control from that point of time, in step S119. In other words, determination unit 114 does not start the toner supply control for a prescribed time required for agitating from the start of the printing operation. Accordingly, the normal-mode toner supply control is delayed for the time taken for the developing agitating operation from the start of the printing operation, before being started, and the toner supply operation is thereafter performed in which toner is supplied at a timing depending on the amount of toner in developing unit 4. The printing operation continues for the above-noted time whereby toner in developing unit 4 is agitated by rotation of developing roller 61 and the like by the printing operation. When the print job is ended, in step S121, determination unit 114 ends the printing operation. A series of operations is then ended.

As a result of the developing agitation control as illustrated in the flowchart of FIG. 7 being performed in engine 100 of printer 1, the developing agitating operation is performed not based on the time during which printer 1 is not operated but based on the shortage amount of toner in developing unit 4. More specifically, even during power-on, if toner exists in developing unit 4 in such an amount that a continuous printing operation is possible, toner in developing unit 4 can be agitated by performing a printing operation for the time taken for the developing agitating operation, so that the start of toner supply control can be delayed at least for the time taken for the developing agitating operation, thereby eliminating the need for the developing agitating operation prior to the start of toner supply control. Such control by control unit 101 can reduce the frequency of execution of the developing agitating operation, as compared with the case where the developing agitating operation is done every time the power is turned on. Although the frequency of execution of the developing agitating operation is reduced, the bulk density of toner in developing unit 4 can be corrected by performing a printing operation for the time taken for the developing agitating operation before the start of toner supply control, thereby effectively preventing a change of the bulk density of toner in developing unit 4. Moreover, by doing so, a timer for counting the time during which printer 1 is left unused becomes unnecessary.

In the first example, the developing agitating operation is performed in advance, if necessary, at the stage of power-on, that is, at the stage before reception of a printing command, so that a printing operation is not interrupted by the developing agitating operation after the start of the printing operation, and the productivity is thus not reduced. However, in order to reduce the frequency of execution of the developing agitating operation more, as in a second example illustrated in FIG. 8, the developing agitating operation may be performed only when necessary after reception of a printing command.

Figure 8:
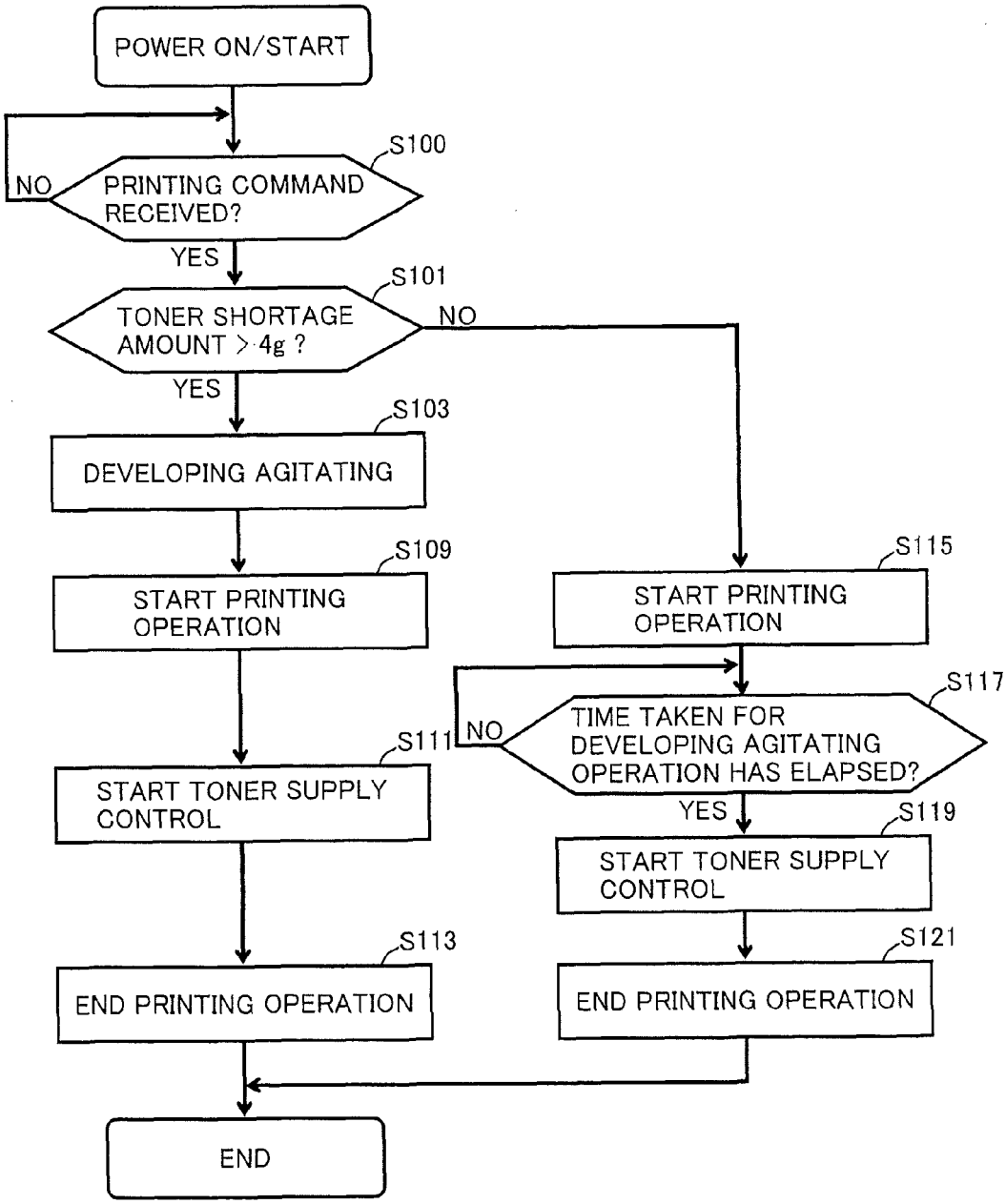
FIG. 8 is a flowchart showing a second example of a flow of developing agitation control in accordance with the first embodiment.

More specifically, referring to FIG. 8, in the second example of the flow of the developing agitation control, at the stage where a printing command is input from controller 200 (YES in step S100), determination unit 114 compares the toner shortage amount stored in toner amount storage unit 113 with the first threshold value of 4 g stored in threshold storage unit 115. After that, determination unit 114 executes the same operations as in the first example. It is noted that in the case where the developing agitating control shown as the second example is performed, determination unit 114 may not include agitation flag 1141. This is applicable to the following examples.

As a result of the developing agitation control illustrated in the flowchart in FIG. 8 being performed in engine 100 of printer 1, the developing agitating operation is performed prior to toner supply control, only when the actual printing operation is designated and when toner supply control needs to be started immediately after the start of printing. Such control by control unit 101 can reduce the frequency of execution of developing agitating operation in printer 1 more and can also prevent a change of the bulk density of toner in the developing device effectively. Accordingly, deterioration of the image quality in printer 1 can be prevented.

[Second Embodiment]

Figure 9:
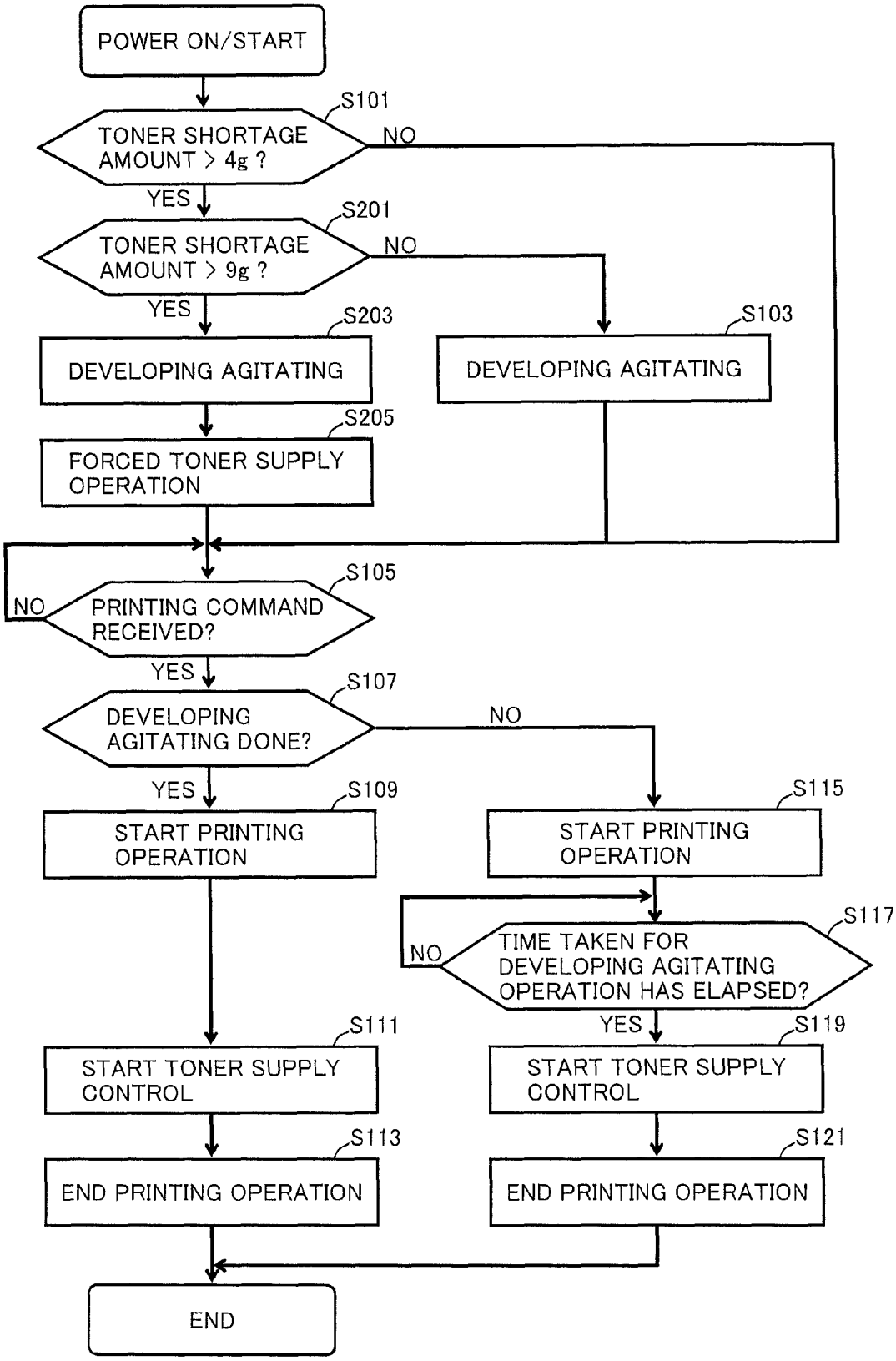
FIG. 9 is a flowchart showing a first example of a flow of developing agitation control in accordance with a second embodiment.

Using FIG. 9, a first example of the flow of developing agitation control in accordance with a second embodiment will be described. In the developing agitation control in accordance with the second embodiment, the developing agitating operation is controlled in consideration of the toner supply operation in the forced mode. The operation shown in the flowchart of FIG. 9 is also started by powering printer 1 on and is realized by control unit 101 of engine 100 reading a necessary program from memory 102 and executing the program in CPU for controlling the units shown in FIG. 5 and FIG. 6. It is noted that in the flowchart in FIG. 9, the same operations as the operations in the flowcharts in FIG. 7 and FIG. 8 are denoted with the same step numbers. This is applicable to the following flowcharts.

Referring to FIG. 9, when printer 1 is powered on and starts operating, determination unit 114 compares the toner shortage amount stored in toner amount storage unit 113 with the first threshold value of 4 g and the second threshold value of 9 g stored in threshold storage unit 115. As a result, if it is determined that the toner shortage amount is greater than 4 g and equal to or less than 9 g (YES in step S101 and NO in S201), determination unit 114 performs the operations in steps S103-S107, S109-S113, similarly to the control in accordance with the first embodiment. If it is determined that the toner shortage amount is equal to or less than 4 g (NO in step S101), determination unit 114 performs the operations in step S105, S107, S115-S121 as well, similarly to the control in accordance with the first embodiment.

If it is determined that the toner shortage amount is greater than 9 g (YES in step S101 and YES in S201), determination unit 114 determines that the forced-mode toner supply operation is necessary, because if a printing operation is thereafter started in response to a printing instruction, the image may be blurred from the onset of a printing operation. Upon such determination, in step S203, determination unit 114 requests agitation control unit 117 to execute the developing agitating operation and allows execution of the developing agitating operation prior to the start of the toner supply operation. Then, in step S205, determination unit 114 requests supply driving unit 118 to execute the forced-mode toner supply operation. After that, the same operations as in the control in accordance with the first embodiment as illustrated in the flowchart in FIG. 7 are performed. More specifically, when a printing command is received from controller 200 (YES in step S105), determination unit 114 determines that the developing agitating operation is done (YES in step S107) by confirming agitation flag 1141, because the developing agitating operation is done in the above-noted step S203. Therefore, determination unit 114 performs the operations in steps S109-S113 without allowing execution of the developing agitating operation prior to the start of the normal-mode toner supply control during the printing operation.

As a result of the developing agitation control illustrated in the flowchart in FIG. 9 being performed in engine 100 of printer 1, the developing agitating operation is not executed if the forced-mode toner supply operation is executed at a stage before the start of printing. This is because, at the start of printing, toner in developing unit 4 has already been agitated by the developing agitating operation executed prior to the forced-mode toner supply operation, and the bulk density of toner has been corrected by agitating toner in developing unit 4, even if the developing agitating operation is not performed prior to the normal-mode toner supply control after the start of printing. Such control by control unit 101 can reduce the frequency of execution of developing agitating operation in printer 1 more.

In the first example, the developing agitating operation is done in advance, if necessary, at a stage of power-on, that is, at a stage before reception of a printing command, so that a printing operation is not interrupted by a developing agitating operation after the start of the printing operation, and the productivity is thus not reduced. However, in order to reduce the frequency of execution of developing agitating operation more, the developing agitating operation may be performed only when necessary after reception of a printing command, similarly to the first embodiment, as in a second example illustrated in FIG. 10.

Figure 10:
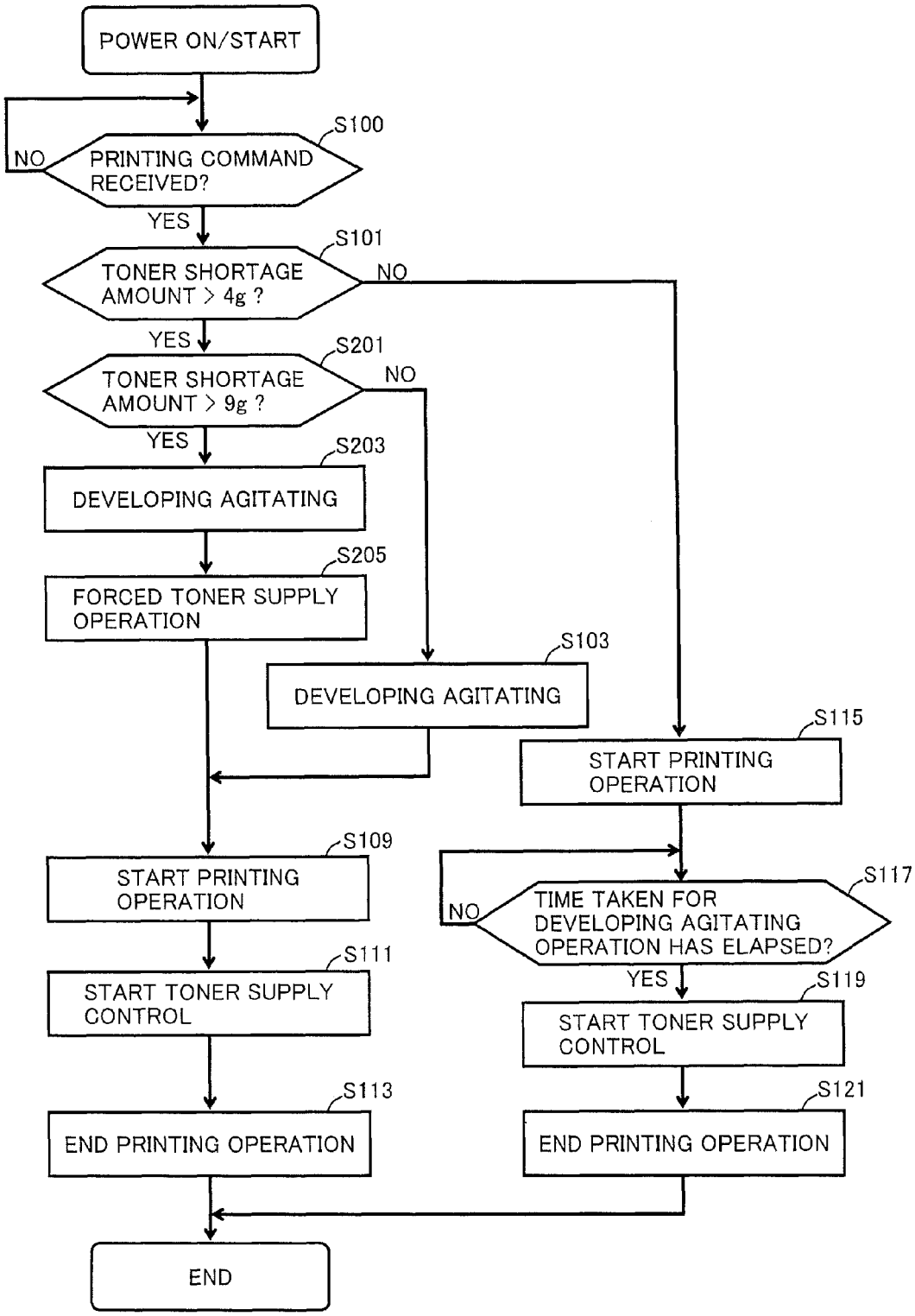
FIG. 10 is a flowchart showing a second example of a flow of developing agitation control in accordance with the second embodiment.

More specifically, referring to FIG. 10, in the second example of the flow of developing agitation control, at the stage where a printing command is input from controller 200 (YES in step S100), determination unit 114 compares the toner shortage amount stored in toner amount storage unit 113 with the first threshold value of 4 g and the second threshold value of 9 g stored in threshold storage unit 115. After that, determination unit 114 executes the same operations as in the first example. More specifically, if it is determined that the toner shortage amount is greater than 9 g at the time of reception of a printing command (YES in step S101 and YES in step S201), in step S203, determination unit 114 requests agitation control unit 117 to execute a developing agitating operation and allows agitation control unit 117 to execute a developing agitating operation. Thereafter, in step S205, determination unit 114 requests supply driving unit 118 to execute the forced-mode toner supply operation. Since toner in developing unit 4 has already been agitated prior to the start of normal-mode toner supply control during a printing operation, also in this case, determination unit 114 performs the operations in steps S109-S113 without allowing execution of a developing agitating operation prior to the start of normal-mode toner supply control during a printing operation.

As a result of the developing agitation control illustrated in the flowchart in FIG. 10 being performed in engine 100 of printer 1, the developing agitating operation is not executed if the forced-mode toner supply operation is performed, even when the actual printing operation is designated and toner in developing unit 4 falls short. Such control by control unit 101 can reduce the frequency of execution of developing agitating operation in printer 1 more and can also prevent a change of the bulk density of toner in the developing device effectively. Accordingly, deterioration of the image quality in printer 1 can be prevented.

[Third Embodiment]

In a third embodiment, determination unit 114 includes a sensor flag 1142. Determination unit 114 determines whether a sensor signal received from sensor 65 by sensor reception unit 116 is a toner full signal or a toner low signal, and if it is a toner full signal, sets sensor flag 1142, and if it is a toner low signal, clears the flag. Sensor flag 1142 may be used in the reverse way as long as it indicates one of the aforementioned states (the toner full state and the toner low state). Sensor flag 1142 is also formed in a region of the non-volatile memory. Therefore, the information is held even during power-off, and the toner full state or the toner low state at the time of the previous power-off can be known by confirming the flag at the time of power-on.

Using FIG. 11, a first example of the flow of developing agitation control in accordance with the third embodiment will be described. The toner shortage amount stored in toner amount storage unit 113 is a value obtained from the toner amount calculated based on the number of dots of image data specified by analysis unit 211 of controller 200. However, the accuracy of the stored toner shortage amount may be low depending on the analysis accuracy of analysis unit 211. Then, in the third embodiment, a developing agitating operation is controlled in consideration of the detection result in sensor 65. The operation shown in the flowchart in FIG. 11 is also started by powering printer 1 on and is realized by control unit 101 of engine 100 reading a necessary program from memory 102 and executing the program in CPU for controlling the units shown in FIG. 5 and FIG. 6.

Figure 11:
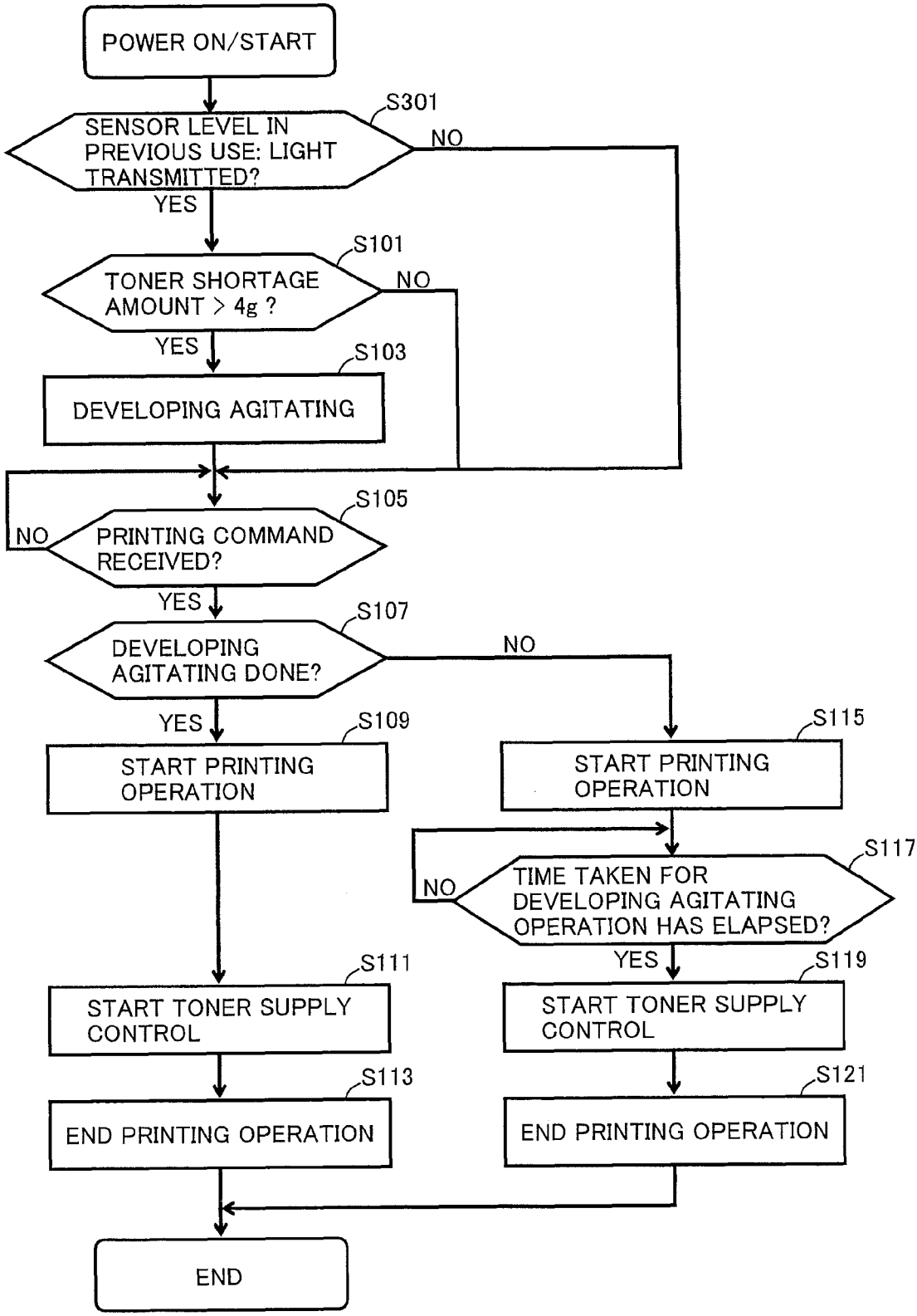
FIG. 11 is a flowchart showing a first example of a flow of developing agitation control in accordance with a third embodiment.

Referring to FIG. 11, when printer 1 is powered on and starts operating, determination unit 114 confirms the toner full state or the toner low state at the time of the previous power-off by confirming whether sensor flag 1142 is set or not. If it is determined that light applied from the light-emitting element of sensor 65 is transmitted and received by the light-receiving element at the time of the previous power-off, that is, if it is determined that a sensor signal indicating the toner low state is input from sensor 65 at the time of the previous power-off (YES in step S301), determination unit 114 performs the similar control as the control in accordance with the first embodiment shown in FIG. 7, after that.

If it is determined that light applied from the light-emitting element of sensor 65 is not transmitted to the light-receiving element at the time of the previous power-off, that is, if it is determined that a sensor signal indicating the toner full state is input from sensor 65 at the time of the previous power-off (NO in step S301), toner supply is not necessary immediately after the start of a printing operation. Therefore, determination unit 114 does not allow the developing agitating operation prior to the start of a printing operation, and steps S101, S103 are skipped. In this case, similarly to the control in accordance with the first embodiment, determination unit 114 performs the operations in steps S105, S107, S115-S121 to delay the start of normal-mode toner supply control at least for the time taken for the developing agitating operation from the start of the printing operation.

As a result of the developing agitation control illustrated in the flowchart in FIG. 11 being performed in engine 100 of printer 1, the developing agitating operation is not performed at the start of printing, if the toner full state is attained at the time of the previous power-off. Such control by control unit 101 can reduce the frequency of execution of the developing agitating operation in printer 1 more.

In the first example, the developing agitating operation is performed in advance, if necessary, at the stage of power-on, that is, at the stage before reception of a printing command, so that a printing operation is not interrupted by the developing agitating operation after the start of the printing operation, and the productivity is thus not reduced. However, in order to reduce the frequency of execution of the developing agitating operation more, the developing agitating operation may be performed only when necessary after reception of a printing command, similarly to the first embodiment, as in a second example illustrated in FIG. 12.

Figure 12:
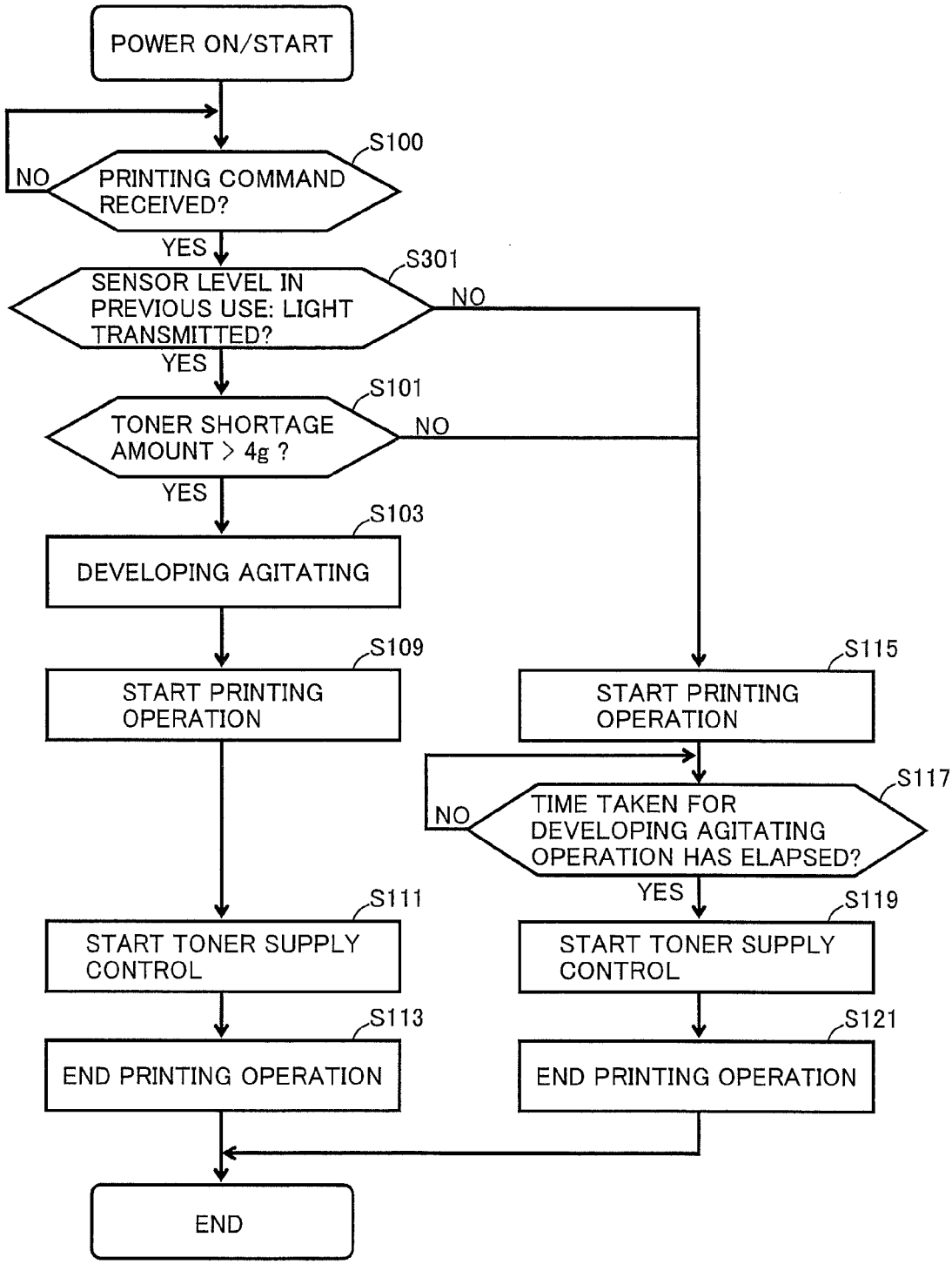
FIG. 12 is a flowchart showing a second example of a flow of developing agitation control in accordance with the third embodiment.

More specifically, referring to FIG. 12, in the second example of the flow of developing agitation control, at the stage where a printing command is input from controller 200 (YES in step S100), determination unit 114 confirms the toner full state or the toner low state at the time of the previous power-off. After that, determination unit 114 executes the same operations as in the first example. More specifically, if it is determined that a sensor signal indicating the toner full state is input from sensor 65 at the time of the previous power-off (NO in step S301), determination unit 114 performs the operations in steps S105, S107, S115-S121 to delay the start of normal-mode toner supply control at least for the time taken for the developing agitating operation from the start of the printing operation.

As a result of the developing agitation control illustrated in the flowchart in FIG. 12 being performed in engine 100 of printer 1, the developing agitating operation is executed only when the actual printing operation is designated and when the actual toner in developing unit 4 detected by sensor 65 falls short of the toner full state. Such control by control unit 101 can reduce the frequency of execution of developing agitating operation in printer 1 more while preventing a change of the bulk density of toner in the developing device effectively. Accordingly, deterioration of the image quality in printer 1 can be prevented.

[Fourth Embodiment]

Figure 13:
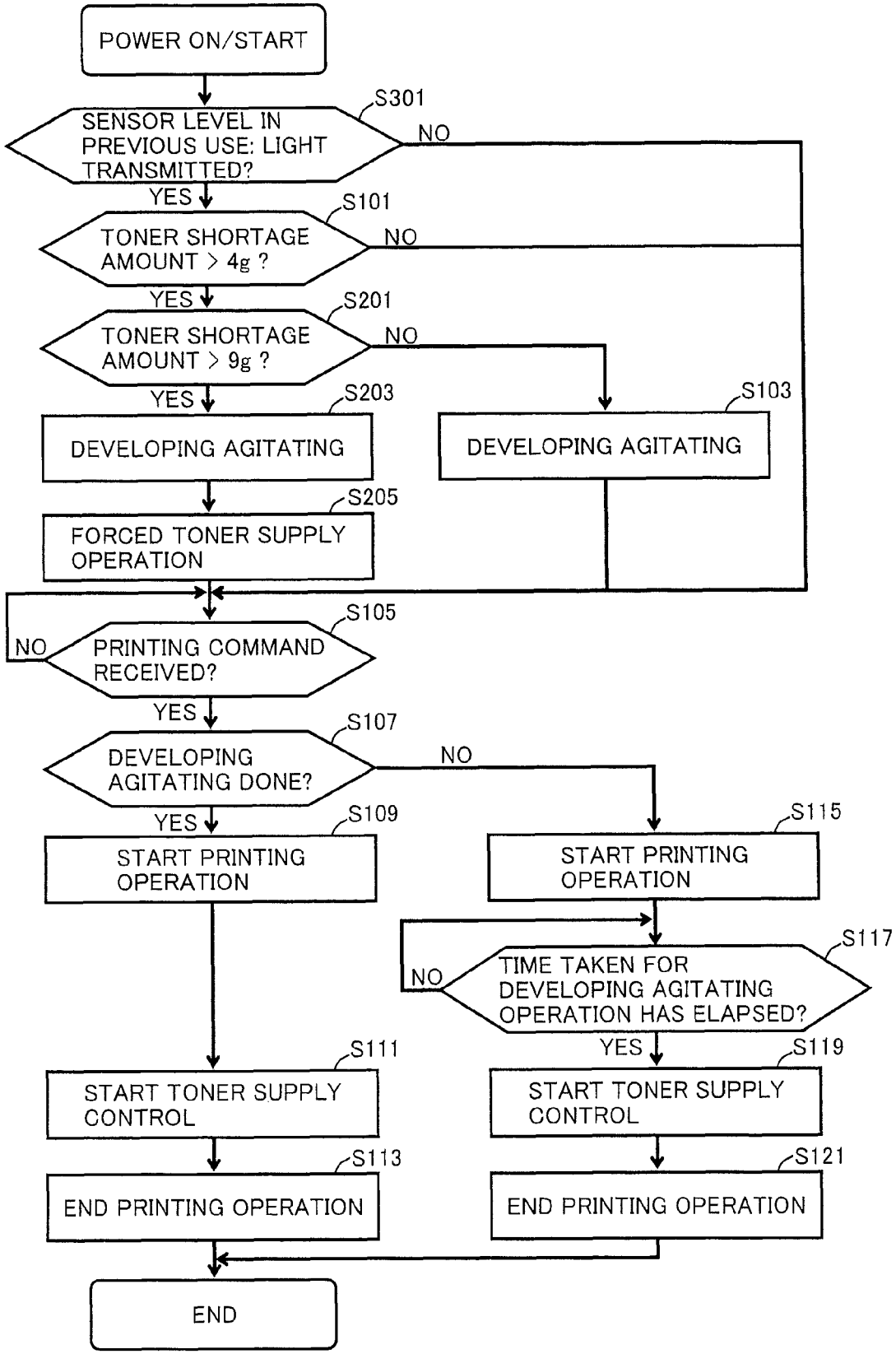
FIG. 13 is a flowchart showing a first example of a flow of developing agitation control in accordance with a fourth embodiment.

It is noted that the developing agitation controls in accordance with the first to third embodiments may be combined. Referring now to FIG. 13, a combination of the first examples of developing agitation control in accordance with the first to third embodiments will be described as a first example of developing agitation control in accordance with a fourth embodiment. Also in the fourth embodiment, determination unit 114 includes sensor flag 1142. The operation shown in the flowchart in FIG. 13 is also started by powering printer 1 on and is realized by control unit 101 of engine 100 reading a necessary program from memory 102 and executing the program in CPU for controlling the units shown in FIG. 5 and FIG. 6.

Referring to FIG. 13, when printer 1 is powered on and starts operating, determination unit 114 confirms the toner full state or the toner low state at the time of the previous power-off by confirming whether sensor flag 1142 is set or not. If it is determined that a sensor signal indicating the toner low state is input from sensor 65 at the time of the previous power-off (YES in step S301), determination unit 114 compares the toner shortage amount stored in toner amount storage unit 113 with the first threshold value of 4 g and the second threshold value of 9 g stored in threshold storage unit 115.

As a result of the comparison, if it is determined that the toner shortage amount is greater than 4 g and equal to or less than 9 g (YES in step S101 and NO in S201), in step S103, determination unit 114 requests agitation control unit 117 to execute a developing agitating operation, and upon execution of the operation, sets agitation flag 1141.

If it is determined that the toner shortage amount is greater than 9 g (YES in step S101 and YES in S201), determination unit 114 requests agitation control unit 117 to execute the developing agitating operation in step S203, and then requests supply driving unit 118 to execute the forced-mode toner supply operation in step S205.

If it is determined that the toner shortage amount is equal to or less than 4 g (NO in step S101), determination unit 114 skips step S103 or steps S203, S205.

If it is determined that a sensor signal indicating the toner full state is input from sensor 65 at the time of the previous power-off (NO in step S301), steps S101, S103, S201-S205 are skipped.

Then, if a printing command is input from controller 200 (YES in step S105), determination unit 114 confirms whether the developing agitating operation is done in advance or not by confirming whether agitation flag 1141 is set or not. If it is determined that the developing agitating operation is done in advance, in the above-noted step S103 or step S203 (YES in step S107), that is, if the toner shortage amount is greater than 4 g, or if the forced-mode toner supply operation is executed, in step S109, determination unit 114 allows printing control unit 119 to start a printing operation in accordance with the aforementioned command. Furthermore, in step S111, determination unit 114 starts the normal-mode toner supply control immediately after the start of the printing operation. Accordingly, the normal-mode toner supply control is started without the developing agitating operation being performed prior to the start of toner supply control after the start of the printing operation, and thereafter a toner supply operation is performed in which toner is supplied at a timing depending on the amount of toner in developing unit 4. When the printing job is ended, in step S113, determination unit 114 ends the printing operation. A series of operations is then ended.

If it is determined that the developing agitating operation is not performed in advance (NO in step S107), that is, if the toner full state is attained at the time of the previous power-off, if the toner shortage amount is less than 4 g, toner exists in developing unit 4 in such an amount that printing is possible, at the start of a printing operation, and therefore there is no need for supplying toner immediately after the start of a printing operation. In this case, in step S115, determination unit 114 allows printing control unit 119 to start the normal printing operation in accordance with the aforementioned command. Then, upon the start of the printing operation, determination unit 114 determines that the normal-mode toner supply control is started at the timing later than the start of the printing operation at least by the time taken for the developing agitating operation. Upon such determination, determination unit 114 detects the elapsed time of the printing operation corresponding to the time taken for the developing agitating operation from the start of the printing operation in step S115 (YES in step S117) and starts the normal-mode toner supply control at that point of time, in step S119. Accordingly, the normal-mode toner supply control is delayed for the time taken for the developing agitating operation from the start of the printing operation, before being started, and the toner supply operation is thereafter performed in which toner is supplied at a timing depending on the amount of toner in developing unit 4. Through the continuous printing operation for the above-noted time, toner in developing unit 4 is agitated by rotation of developing roller 61 and the like by the printing operation. When the print job is ended, in step S121, determination unit 114 ends the printing operation. A series of operations is then ended.

As a result of the developing agitation control illustrated in the flowchart in FIG. 13 being performed in engine 100 of printer 1, the shortage amount of toner in developing unit 4 is determined accurately at a stage before the start of a printing operation, and based on this determination, whether the developing agitating operation is required or not is determined. Such control by control unit 101 can reduce the frequency of execution of developing agitating operation in printer 1 more effectively.

Furthermore, using FIG. 14, a combination of the second examples of developing agitation control in accordance with the first to third embodiments will be described as a second example of developing agitation control in accordance with the fourth embodiment. Also in the fourth embodiment, determination unit 114 includes sensor flag 1142.

Figure 14:
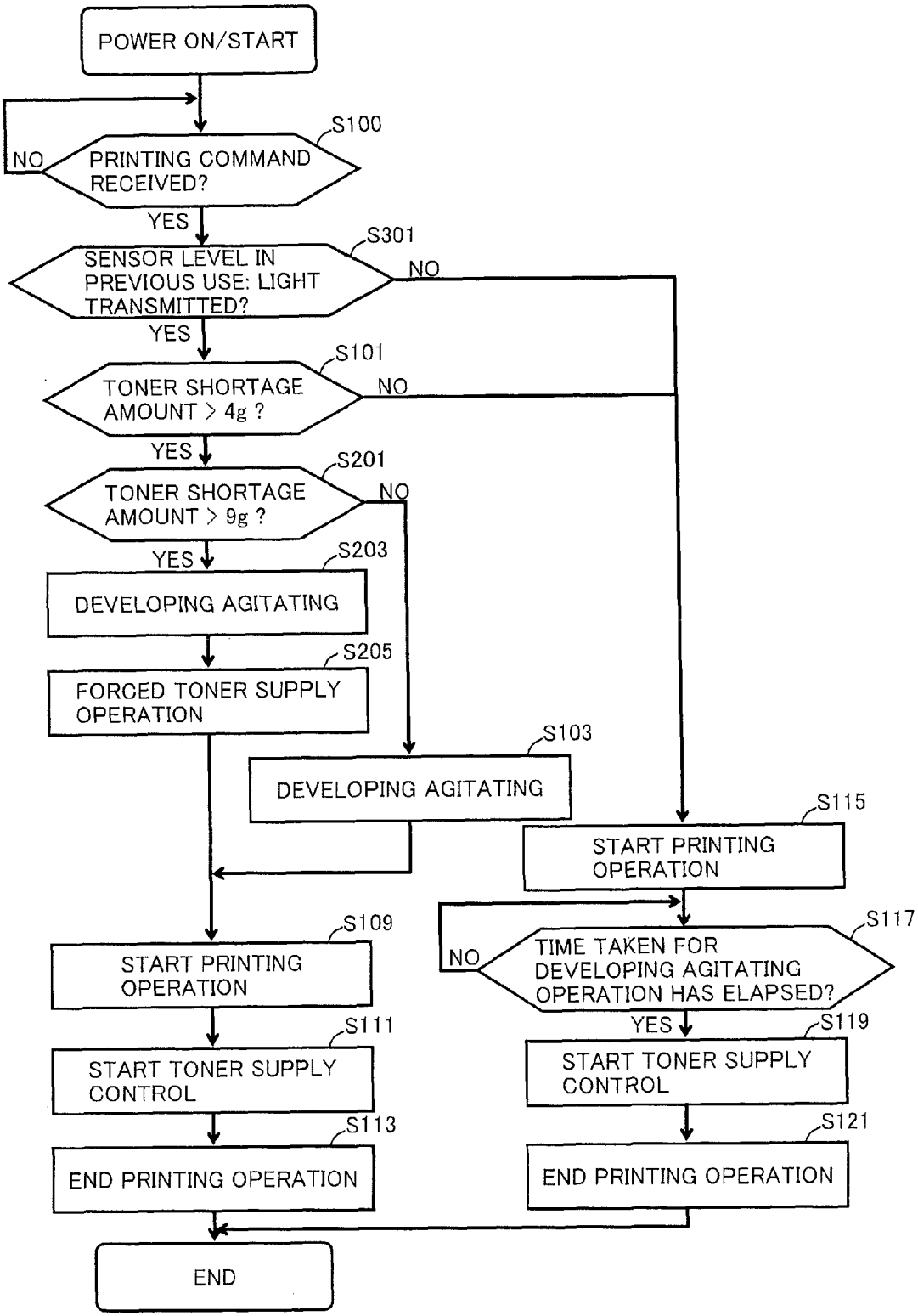
FIG. 14 is a flowchart showing a second example of a flow of developing agitation control in accordance with the fourth embodiment.

Referring to FIG. 14, at the stage where a printing command is input from controller 200 (YES in step S100), determination unit 114 confirms the toner full state or the toner low state at the time of the previous power-off by confirming whether sensor flag 1142 is set or not. If it is determined that a sensor signal indicating the toner low state is input from sensor 65 at the time of the previous power-off (YES in step S301), determination unit 114 compares the toner shortage amount stored in toner amount storage unit 113 with the first threshold value of 4 g and the second threshold value of 9 g stored in threshold storage unit 115.

As a result of the comparison, if it is determined that the toner shortage amount is greater than 4 g and equal to or less than 9 g (YES in step S101 and NO in S201), in step S103, determination unit 114 requests agitation control unit 117 to execute the developing agitating operation. Thereafter, in step S109, determination unit 114 allows printing control unit 119 to start a printing operation in accordance with the above-noted command. Furthermore, in step S111, determination unit 114 starts the normal-mode toner supply control immediately after the start of the printing operation. Accordingly, the normal-mode toner supply control is started without the developing agitating operation being performed prior to the start of toner supply control after the start of the printing operation, and the toner supply operation is thereafter performed in which toner is supplied at a timing depending on the amount of toner in developing unit 4. When the print job is ended, in step S113, determination unit 114 ends the printing operation. A series of operations is then ended.

If it is determined that the toner shortage amount is greater than 9 g (YES in step S101 and NO in S201), determination unit 114 requests agitation control unit 117 to execute the developing agitating operation in step S203, and then requests supply driving unit 118 to execute the forced-mode toner supply operation in step S205. Thereafter, in step S109, determination unit 114 allows printing control unit 119 to start a printing operation in accordance with the above-noted command. Furthermore, in step S111, determination unit 114 starts the normal-mode toner supply control immediately after the start of the printing operation. Accordingly, the normal-mode toner supply control is started without the developing agitating operation being performed prior to the start of toner supply control after the start of the printing operation, and the toner supply operation is thereafter performed in which toner is supplied at a timing depending on the amount of toner in developing unit 4. When the print job is ended, in step S113, determination unit 114 ends the printing operation. A series of operations is then ended.

If it is determined that the toner shortage amount is equal to or less than 4 g (NO in step S101) or if it is determined that a sensor signal indicating the toner full state is input from sensor 65 at the time of the previous power-off (NO in step S301), in step S115, determination unit 114 allows printing control unit 119 to start the normal printing operation in accordance with the above-noted command. Determination unit 114 detects the elapsed time of the printing operation corresponding to the time taken for the developing agitating operation from the start of the printing operation in step S115 (YES in step S117), and starts the normal-mode toner supply control at that point of time in step S119. Accordingly, the normal-mode toner supply control is delayed for the time taken for the developing agitating operation from the start of the printing operation, before being started, and the toner supply operation is thereafter performed in which toner is supplied at a timing depending on the amount of toner in developing unit 4. Through the continuous printing operation for the above-noted time, toner in developing unit 4 is agitated by rotation of developing roller 61 and the like by the printing operation. When the print job is ended, in step S121, determination unit 114 ends the printing operation. A series of operations is then ended.

As a result of the developing agitation control illustrated in the flowchart in FIG. 14 being performed in engine 100 of printer 1, the shortage amount of toner in developing unit 4 is determined accurately when the actual printing operation is designated, and based on this determination, whether the developing agitating operation is required or not is determined. Such control by control unit 101 can reduce the frequency of execution of developing agitating operation in printer 1 more.

In the forgoing examples, the developing agitation control is performed at the time of power-on or when a printing command is received. However, the developing agitation control may be performed at any timing between the power-on and the start of a printing operation. Another timing at which the developing agitation control is performed may be the time when printer 1 returns from the sleep state or the time when a printing job is received.

In the foregoing examples, in the case where the developing agitation control is started at the time of power-on (the case in the first example), determination unit 114 is configured to include agitation flag 1141 in order that determination unit 114 may determine whether a developing agitating operation has already been performed or not at the time of reception of a printing command. However, the method for making the above-noted determination is not limited to the use of the agitation flag, and any other methods may be employed.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image forming apparatus comprising:

a toner container unit;

a developing device including an agitating unit for agitating toner;

an image forming unit for forming a toner image on printing medium based on image data using said developing device;

a supply unit for supplying toner from said toner container unit to said developing device;

a memory for storing a shortage amount of toner in said developing device; and a controller for performing i) supply control for allowing said supply unit to execute a supply operation based on an amount of toner in said developing device to supply toner from said toner container unit to said developing device, and ii) image forming control for allowing said image forming unit to execute an image forming operation to form a toner image on said printing medium, wherein said controller performs first control of allowing execution of an agitating operation to agitate toner in said developing device by said agitating unit before the start of said image forming operation, and allowing execution of said agitating operation by said agitating unit and starting said supply control upon the start of said image forming operation, when said shortage amount of toner at a time of power-on is greater than a first threshold value and equal to or less than a second threshold value greater than said first threshold value, and second control of allowing execution of said agitating operation by said agitating unit upon the start of said image forming operation without allowing execution of said agitating operation by said agitating unit before the start of said image forming operation, and starting said supply control after a time for a predetermined developing agitating operation after the start of said image forming operation, when said shortage amount of toner at a time of power-on is smaller than said first threshold value, and third control of allowing execution of said agitating operation by said agitating unit before the start of said image forming operation and allowing execution of said supply operation by said supply unit after said agitating operation and before the start of said image forming operation, when said shortage amount of toner obtained at a time of power-on is greater than said second threshold value.

2. The image forming apparatus according to claim 1, further comprising a sensor for detecting whether a prescribed amount of toner exists or not in said developing device, wherein said shortage amount of toner is an amount that falls short of said prescribed amount of toner detected by said sensor, and said controller performs said third control when it is detected by said sensor that said prescribed amount of toner does not exist in said developing device at a time of power-on and when said shortage amount of toner is greater than said second threshold value.

3. The image forming apparatus according to claim 1, further comprising a sensor for detecting whether a prescribed amount of toner exists or not in said developing device, wherein said shortage amount of toner is an amount that falls short of said prescribed amount of toner detected by said sensor, and said controller performs said first control when it is detected by said sensor that said prescribed amount of toner does not exist in said developing device at a time of power-on and when said shortage amount of toner is greater than said first threshold value, and said second control when it is detected by said sensor that said prescribed amount of toner exists in said developing device at a time of power-on or when said shortage amount of toner is smaller than said first threshold value.

4. The image forming apparatus according to claim 1, further comprising a calculation unit for calculating the shortage amount of toner in said developing device based on said image data.

5. An image forming apparatus comprising:

a toner container unit;

a developing device including an agitating unit for agitating toner;

an image forming unit for forming a toner image on printing medium based on image data using said developing device;

a supply unit for supplying toner from said toner container unit to said developing device;

a memory for storing a shortage amount of toner in said developing device; and a controller for performing i) supply control for allowing said supply unit to execute a supply operation based on an amount of toner in said developing device to supply toner from said toner container unit to said developing device, and ii) image forming control for allowing said image forming unit to execute an image forming operation to form a toner image on said printing medium, wherein said controller performs first control of allowing execution of an agitating operation to agitate toner in said developing device by said agitating unit before the start of said image forming operation, and allowing execution of said agitating operation by said agitating unit and starting said supply control upon the start of said image forming operation, when said shortage amount of toner is greater than a first threshold value and equal to or less than a second threshold value greater than said first threshold value at a time when image formation is requested, second control of allowing execution of said agitating operation by said agitating unit upon the start of said image forming operation without allowing execution of said agitating operation by said agitating unit before the start of said image forming operation, and starting said supply control after a time for a predetermined developing agitating operation after the start of said image forming operation, when said shortage amount of toner is smaller than said first threshold value at a time when image formation is requested and third control of allowing execution of said agitating operation by said agitating unit before the start of said image forming operation and allowing execution of said supply operation by said supply unit after said agitating operation and before the start of said image forming operation, when said shortage amount of toner obtained at a time of power-on is greater than said second threshold value.

6. The image forming apparatus according to claim 5, further comprising a sensor for detecting whether a prescribed amount of toner exists or not in said developing device, wherein said shortage amount of toner is an amount that falls short of said prescribed amount of toner detected by said sensor, and said controller performs said third control when it is detected by said sensor that said prescribed amount of toner does not exist in said developing device at a time when image formation is requested and when said shortage amount of toner is greater than said second threshold value.

7. The image forming apparatus according to claim 5, further comprising a sensor for detecting whether a prescribed amount of toner exists or not in said developing device, wherein said shortage amount of toner is an amount that falls short of said prescribed amount of toner detected by said sensor, and said controller performs said first control when it is detected by said sensor that said prescribed amount of toner does not exist in said developing device at a time when image formation is requested and if said shortage amount of toner is greater than said first threshold value, and said second control when it is detected by said sensor that said prescribed amount of toner exists in said developing device at a time when image formation is requested or if said shortage amount of toner is smaller than said first threshold value.

8. The image forming apparatus according to claim 5, further comprising a calculation unit for calculating the shortage amount of toner in said developing device based on said image data.

9. An image forming apparatus comprising:

a toner container unit;

a developing device including an agitating unit for agitating toner;

an image forming unit for forming a toner image on printing medium based on image data using said developing device;

a calculation unit for calculating a shortage amount of toner in said developing device based on said image data;

a supply unit for supplying toner from said toner container unit to said developing device;

a memory for storing the shortage amount of toner in said developing device; and a controller for performing i) supply control for allowing said supply unit to execute a supply operation based on an amount of toner in said developing device to supply toner from said toner container unit to said developing device, and ii) image forming control for allowing said image forming unit to execute an image forming operation to form a toner image on said printing medium, wherein said controller performs first control of allowing execution of an agitating operation to agitate toner in said developing device by said agitating unit before the start of said image forming operation, and allowing execution of said agitating operation by said agitating unit and starting said supply control upon the start of said image forming operation, when said shortage amount of toner at a time of power-on is greater than a first threshold value and equal to or less than a second threshold value greater than said first threshold value, and second control of allowing execution of said agitating operation by said agitating unit upon the start of said image forming operation without allowing execution of said agitating operation by said agitating unit before the start of said image forming operation, and starting said supply control after a time for a predetermined developing agitating operation after the start of said image forming operation, when said shortage amount of toner at a time of power-on is smaller than said first threshold value.

10. An image forming apparatus comprising:

a toner container unit;

a developing device including an agitating unit for agitating toner;

an image forming unit for forming a toner image on printing medium based on image data using said developing device;

a calculation unit for calculating a shortage amount of toner in said developing device based on said image data;

a supply unit for supplying toner from said toner container unit to said developing device;

a memory for storing the shortage amount of toner in said developing device; and a controller for performing i) supply control for allowing said supply unit to execute a supply operation based on an amount of toner in said developing device to supply toner from said toner container unit to said developing device, and ii) image forming control for allowing said image forming unit to execute an image forming operation to form a toner image on said printing medium, wherein said controller performs first control of allowing execution of an agitating operation to agitate toner in said developing device by said agitating unit before the start of said image forming operation, and allowing execution of said agitating operation by said agitating unit and starting said supply control upon the start of said image forming operation, when said shortage amount of toner is greater than a first threshold value and equal to or less than a second threshold value greater than said first threshold value at a time when image formation is requested, and second control of allowing execution of said agitating operation by said agitating unit upon the start of said image forming operation without allowing execution of said agitating operation by said agitating unit before the start of said image forming operation, and starting said supply control after a time for a predetermined developing agitating operation after the start of said image forming operation, when said shortage amount of toner is smaller than said first threshold value at a time when image formation is requested.

* * * * *